United States Patent [19]

Baltschun

[11] 4,203,359

[45] May 20, 1980

[54] HYDRAULICALLY DRIVEN PRESS

[75] Inventor: Horst Baltschun, Rülzheim, Fed. Rep. of Germany

[73] Assignee: SMG Süddeutsche Maschinenbau-Gesellschaft mbH, Fed. Rep. of Germany

[21] Appl. No.: 938,957

[22] Filed: Sep. 1, 1978

[30] Foreign Application Priority Data

Sep. 1, 1977 [DE] Fed. Rep. of Germany ..... 2739340

[51] Int. Cl.[2] ..... B30B 15/16

[52] U.S. Cl. ..... 100/209; 100/257; 100/269 R; 100/270

[58] Field of Search ..... 100/209, 257, 269 R, 100/270

[56] References Cited

U.S. PATENT DOCUMENTS

| | | | |
|---|---|---|---|
| 3,507,143 | 4/1970 | Georg | 100/269 R |
| 3,596,499 | 8/1971 | Sauerbrey | 100/269 R |
| 3,818,825 | 6/1974 | Nowak | 100/269 R |

FOREIGN PATENT DOCUMENTS

| | | | |
|---|---|---|---|
| 411413 | 6/1934 | United Kingdom | 100/209 |

*Primary Examiner*—Billy J. Wilhite

*Attorney, Agent, or Firm*—Craig & Antonelli

[57] ABSTRACT

A hydraulic press arrangement which includes at least one top cross beam and one bottom cross beam with a press ram, displaceable by means of two cylinder-piston units supplied by at least one pressure medium source, being disposed between the top and bottom cross beams. Each cylinder-piston unit includes a cylinder arranged in the bottom cross beam and in the top cross beam with a piston being guided in each of the cylinders. Two pistons of a mutually associated cylinder-piston unit are connected by way of a piston rod to the press ram. With the arrangement of the cylinder-piston units as well as the controlling of the impingement and venting of cylinder chambers, a relaxation of forces acting on the press frame, due to a subsiding of forces acting in the press working space, is prevented.

11 Claims, 3 Drawing Figures

27
2'
26
26
9
9
5
5
10
9'
4
4
9'
4'
4'
2
T1
6
6
W
P
1
8
T2
7
13
15
12
VT
16
3
17
4'
11
4'
9'
4
4
9'
P
14
5
5
M
9
9
3'

2'
9
5
9'
4
4'
6
W1
T1
P
T2
8
19
20
W2
T1
T2
20'
20"
18
4'
9'
4
5
25"
9
25'
3'
9
5
9'
4
4'
2
10
21
23
24
6
A
22
1
7
M
P
11
3
4'
9'
4
5
9
25
30

HYDRAULICALLY DRIVEN PRESS

The present invention relates to a press arrangement and, more particularly, to a hydraulically driven press having a press frame which includes at least one top and one bottom cross beam or crosshead between which a press ram is movable by means of two cylinder-piston units operable in both directions from at least one pressure medium source.

A hydraulically driven press of the aforementioned type has been proposed in, for example, Offenlegungsschrift No. 14 79 815 and U.S. Pat. No. 3,418,689 wherein a cylinder-piston unit is provided on each of two mutually opposite sides of the press ram with a cylinder of the cylinder-piston unit being fixed to the press ram and a piston, guided in the cylinder, is attached to a continuous piston rod which passes through both end walls of the cylinder and is fixed at its respective ends to the top and bottom cross beams or crossheads of the press frame.

A disadvantage of the aforementioned proposed type of press construction resides in the fact that, with this proposed arrangement of the cylinder-piston units, inadequate guidance may be given to the press ram because of the short guide length on the piston rods between the end walls of the cylinders. Consequently, additional guide means may be provided on the press ram which cooperate with guide columns extending between the two cross beams or crossheads. However, the guide length of the additional guide means is also restricted substantially to the height of the press ram.

The aim underlying the present invention essentially resides in providing a hydraulically driven press having cylinder-piston units so arranged so as to serve as a sole guide means for the press ram.

According to the present invention, a hydraulically operated press is provided which includes a top and bottom cross beam between which is displaceably mounted a press ram which is movable in both directions by at least two cylinder-piston units which are supplied by at least one pressure medium source with at least one cylinder being arranged in the bottom and top cross beam in which is guided a piston operable or impingeable in only one direction. The two pistons associated with a cylinder-piston unit are connected together by a piston rod which is fixedly mounted to the press ram. By virtue of this arrangement, the guide length for the press ram is advantageously determined by the interval between the two cylinders of the respective individual cylinder-piston units and by the length of the relevant piston rod so that the working space, as viewed in the direction of movement of the press ram, lies entirely within the guide length. Therefore, the respective cylinder-piston units have the sole responsibility for the guidance of the press ram.

According to another advantageous feature of the present invention, a pressure medium working space for the respective cylinder-piston units is provided between the press ram and the top and bottom cross beams or crossheads. By virtue of the arrangement of the two working spaces in the press in such a manner each of the two strokes of the working cycle is simultaneously a return stroke with respect to the one working space and a working stroke with respect to the other working space.

According to a further advantageous feature of the present invention, an auxiliary drive for an idle stroke preceding the work stroke in the direction of the work stroke may be provided for the press ram. For this purpose, the cylinder chambers of each cylinder-piston unit associated with the piston surfaces acted upon by the pressure medium are connected together by conduits separable by at least one controllable valve with the pressure medium source being connected to a conduit between the valve and a cylinder chamber which is associated with the piston surface operable in the direction of the work stroke while a conduit leading to the other cylinder chamber can be relieved of pressure during the separation by way of the valve.

Moreover, according to the present invention, it is possible to provide an auxiliary drive for the idle strokes preceding the work strokes of the press ram in both directions thereof. For this purpose, the cylinder chambers of each cylinder-piston unit associated with the impingeable or effective piston surfaces of the respective pistons are connected together by pipe or conduits separable by means of a controllable valve with the valve being operable so as to selectively connect the two cylinder chambers which are associated with the piston surfaces effective in both directions of the work strokes. The valve functions to connect a pipe or conduit to the pressure medium source while venting another pipe or conduit leading to the respective other cylinder chamber.

By virtue of the auxiliary drives in accordance with the present invention, during a work stroke of the press ram, that is, during each stroke of a press with two working spaces, the idle stroke preceding the commencement of the working process in a working space can be rapidly traveled while simultaneously the pressure medium pressure is maintained in the mutually opposite cylinder chambers and is consequently immediately present in the relevant cylinder chamber at the commencement of the working process and does not have to be first built up.

According to yet another feature of the present invention, a throttle means, effective in a discharge direction, is connected to a pipe or conduit which, in turn, is connected to the respective other cylinder chamber during a venting operation. By virtue of the disposition of the throttle point in the manner of the present invention, the deceleration of the movement of the press ram in the direction of the working stroke can be achieved during the working process in accordance with the requirements thereof while an adjustment of the deceleration can be made possible by an adjustability of the throttle means.

Additionally, according to the present invention, a flow regulating valve effective in the discharge direction is connected to a pipe or conduit which is connected to the respective other cylinder chamber during the venting. By virtue of this arrangement, the speed of the movement of the press ram in a direction of the working stroke during a working process can be determined in accordance with the specific requirements while adjustment of the speed can be made possible by the adjustability of the flow regulator valve.

With the arrangement of the cylinder-piston units, the control of the impingement of the pressure medium on the effective piston surfaces, and the venting of the chambers which is achieved by connecting and controlling the pressure medium conduits by the at least one controllable valve and possibly in conjunction with the adjustable throttle means or flow regulator valve, in accordance with the present invention, it is possible to advantageously realize a relaxation of forces acting upon the press frame, that is, a reversal of the expansion of the press frame caused by the forces which occur in conventional presses at the end of the working stroke due to the disappearance of the forces acting in the working space can be avoided.

More particularly, the above-noted advantageous effect is achieved in that the valve is moved at a correctly adjusted time at the completion of the working stroke or working process into a position in which the pressure medium conduits or pipes leading to the two pressure medium chambers of the cylinder-piston units can be connected whereby the expansion of the press frame can be at least approximately maintained by means of the pressure medium pressure.

The above-described effect may also be obtained by the provision of a stop means for each piston or each piston rod in the cross beam or crosshead located in the direction of the work stroke in each case. The provision of stops maintains the expansion of the frame upon completion of the working stroke. In order to adapt to different working strokes or processes, for which the completion of the working stroke occurs in different press ram positions, the stops may be made adjustable. For at least partial maintenance of the expansion of the frame, that is, the prevention or reduction of the expansion of the frame after each work stroke, regardless of the means of the present invention for achieving such effect, has the advantage that the energy of deformation necessary for an expansion of the press frame need not be expanded anew at each working stroke or process and also the time of the working stroke or process can correspondingly be reduced. Moreover, the noise produced by an abrupt relaxation of the press frame is at least reduced.

Accordingly, it is an object of the present invention to provide a hydraulically driven press arrangement which avoids by simple means the shortcomings and disadvantages encountered in the prior art.

Another object of the present invention resides in providing a press arrangement which makes it possible both with regard to existing space conditions and also with regard to a control of the impingement and venting of pressure medium on the pistons of the cylinder chambers to realize an auxiliary drive for a press ram in a simple manner.

Yet another object of the present invention resides in providing a hydraulically driven press arrangement which ensures a correct and accurate guiding of the press ram without requiring the provision of additional guide means.

A further object of the present invention resides in providing a hydraulically driven press arrangement which minimizes if not avoids an expansion of the press frame at the end of each working stroke.

A still further object of the present invention resides in providing a hydraulically driven press arrangement which considerably reduces the noise level of the press operation.

These and other objects, features, and advantages of the present invention will become more apparent from the following description when taken in connection with the accompanying drawings which show, for the purposes of illustration only, two embodiments in accordance with the present invention, and wherein.

Figure 1:
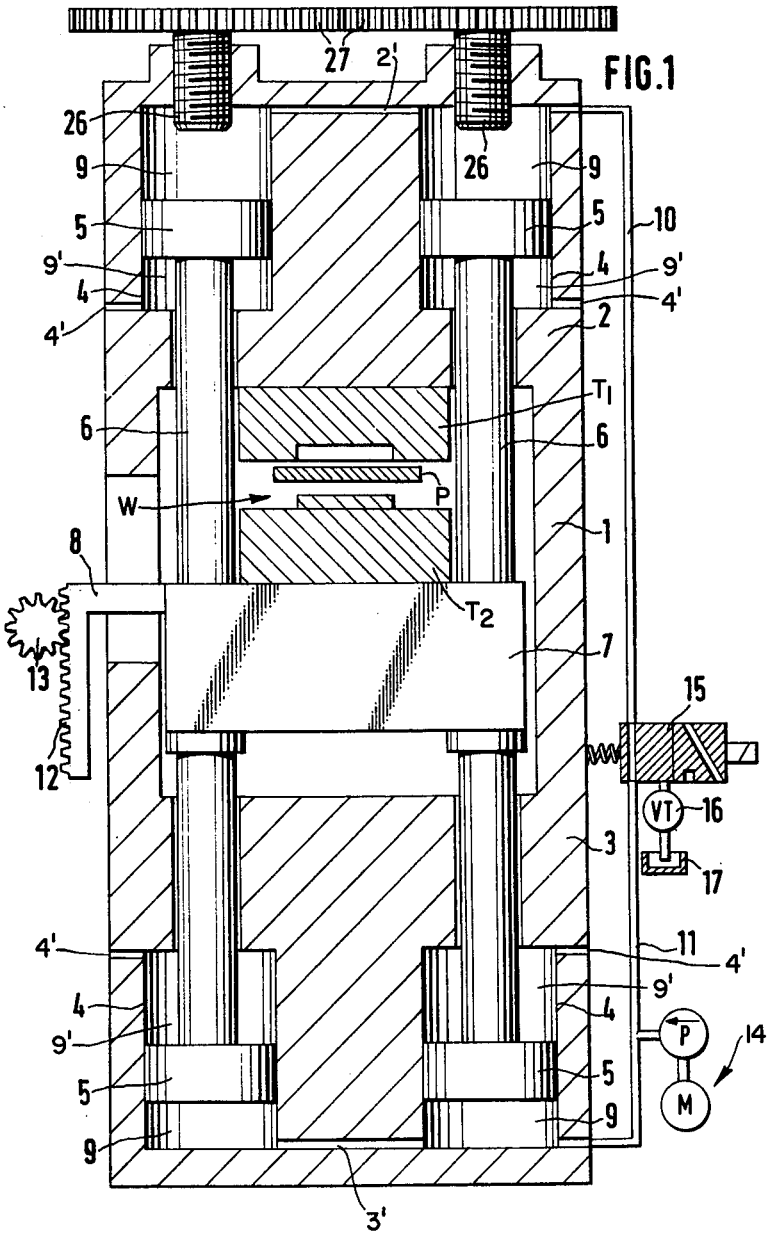
FIG. 1 is a partially schematic vertical cross-sectional view of a hydraulically driven press in accordance with the present invention.

Referring now to the drawings where like reference numerals are used in both views to designate like parts and, more particularly, to FIG. 1, according to this figure, a hydraulically driven press includes a press frame 1 having a top cross beam or crosshead 2 and a bottom cross beam or crosshead 3 with two mutually parallel cylinders 4 being provided in each of the cross beams 2, 3. The cylinders 4 in the cross beam 2 are aligned with the cylinders 4 in the cross beam 3 with each of the two mutually aligned cylinders 4 conjointly forming a cylinder-piston unit with a piston 5 being guided in each of the cylinders 4 and a piston rod 6 connecting the two pistons of the respective cylinder-piston units. A press ram 7 is movably mounted on the press frame 1 with the press ram 7 being fixed to the piston rods 6 of the cylinder-piston units of the cross beams 2, 3.

A bracket 8 is fixed on one side of the press ram 7 so as to provide for an auxiliary drive of the press ram. For this purpose, a rack 12 is fixed to the bracket 8 with the rack 12 meshing with a pinion 13 rotatably mounted about an axle integrally formed with the press frame 1. The pinion 13 is connected to a drive means (not shown) which is drivable in both directions of rotation. The rack 12 and the pinion 13 serve as the auxiliary drive for the press ram 7.

Cylinder chambers 9' of all of the cylinders 4 are vented to the atmosphere by way of venting bores 4'. Each cross beam 2, 3 is provided with communicating bores or passages 2', 3' so as to communicate working pressure cylinder chambers 9 in the respective cross beam 2, 3 to each other. A pressure medium conduit or pipe 10 is connected to the top cross beam 2 and communicates with the cylinder chambers in the cross beam 2 with a further pressure medium conduit or pipe 11 being connected to the bottom cross beam 3 so as to communicate with the cylinder chambers 9 located in the cross beam 3.

A working space generally designated by the reference character W is provided between the press ram 7 and the top cross beam 2. A tool set including a top tool $T_1$ and a bottom tool $T_2$ is arranged in the work space W with the tool set being effective to machine a workpiece P arranged in the work space W.

A pressure medium source generally designated by the reference numeral 14 is provided which includes a pump and motor. The pressure medium source 14 is connected to the pressure medium conduits 10, 11 with a controllable valve 15 being provided for controlling the communication between the pressure medium conduits 10, 11. The valve 15 in the position illustrated in FIG. 1 communicates the pressure medium conduits 10, 11 with each other. In an other or displaced position of the valve 15, the pressure medium conduit 11 is closed and the pressure medium conduit 10 communicates, through an adjustable throttle means 16, with a pressure medium storage tank so that pressure medium from the two cylinder chambers 9 in the upper cross beam 2 can be directed through the throttle means 16 to the storage tank 17.

A stop 26, adjustable by means of a screw thread or the like, is arranged in an end wall of each of the two cylinders 4 located in the top cross beam 2. The adjustable stop 26 is disposed in the top cross beam 2 at a position remote from the press ram 7. The spindles of the adjustable stop 26 are synchronized by way of, for example, a pair of gears 27.

Figure 2:
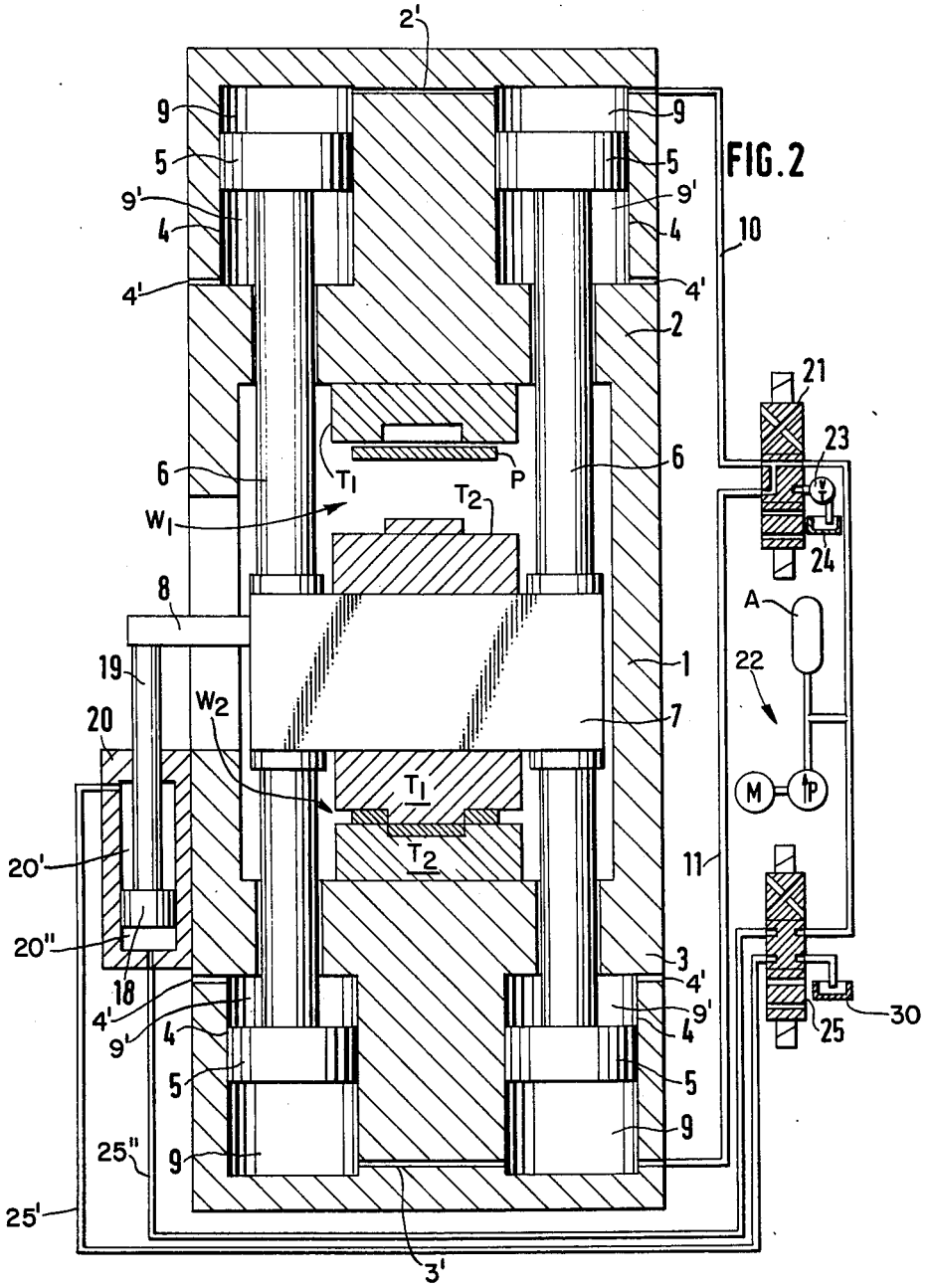
FIG. 2 is a partially schematic vertical cross-sectional view of another embodiment of a hydraulically driven press in accordance with the present invention.

As shown in FIG. 2, two working spaces $W_1$, $W_2$ are provided with one working space $W_1$ being disposed between an upper side of the press ram 7 and the cross beam 2 while the other working space $W_2$ is disposed between a lower side of the press ram 7 and the bottom cross beam 3. A tool set including a top tool $T_1$ and a bottom tool $T_2$ is arranged in each of the work spaces $W_1$, $W_2$ for machining a workpiece P.

As with the press construction of FIG. 1, in the arrangement of FIG. 2, cylinder-piston units are provided which include pairs of mutually aligned cylinders 4 in each of the cross beams 2, 3. Pistons 5 are movably disposed in each of the cylinders 4 with the pistons being connected to each other and the press ram 7 by way of piston rods 6. Cylinder chambers 9' of all of the chambers 4 are vented to the atmosphere by venting bores 4' with each of the cross beams 2, 3 being provided with communicating passages 2', 3' for communicating the working pressure cylinder chambers 9 of the respective cross beams 2, 3 to each other.

An auxiliary piston rod 19 carrying an auxiliary piston 18 is fixed to the bracket 8. The auxiliary piston 18 is guided in an auxiliary cylinder 20, arranged integrally with the press frame 1, and is selectively operable in both directions by impingement of a pressure medium on both piston surfaces. The auxiliary piston 18, the auxiliary piston rod 19, and the auxiliary cylinder 20 conjointly form the auxiliary drive for the press ram 7.

A controllable valve 21 is provided for controlling communication between the pressure medium conduits 10, 11, a pressure medium source generally designated by the reference numeral 22, and a pressure medium storage tank 24. In the central position of the control valve 21 illustrated in FIG. 2, the pressure medium conduits 10, 11 are connected together and to the pressure medium source 22. The pressure medium source 22 includes a pump, motor, and pressure accumulator A. In each of the other two positions of the valve 21, the pressure medium conduits 10, 11 are mutually separated so that, in one position, one pressure medium conduit 10 or 11 is connected to the pressure medium source 22 while the other pressure medium conduit 11 or 10 is connected to the pressure medium storage tank 24 so that the pressure medium flows through an adjustable throttle means 23 into the storage tank 24.

An auxiliary valve 25 is provided for controlling the flow of pressure medium from the pressure medium source 22 through pressure medium conduits or pipes 25', 25" to the auxiliary cylinder 20 in order to operate the auxiliary drive for the press ram 7. In the central position illustrated in FIG. 2, both pressure medium conduits 25', 25" are separated from each other while, in a first displaced position, pressure medium flows from the pressure medium source 22 through the pressure medium conduit 25" to a lower pressure space 20" of the auxiliary cylinder 20 with the upper pressure space 20' being in communication with a pressure medium storage tank 30. In a second displaced position of the auxiliary valve 25, pressure medium flows from the pressure medium source 22 through the pressure medium conduit 25' to the upper pressure space 20' with the lower pressure space 20" being in communication with the pressure medium storage tank 30 by way of the pressure medium conduit 25".

Figure 3:
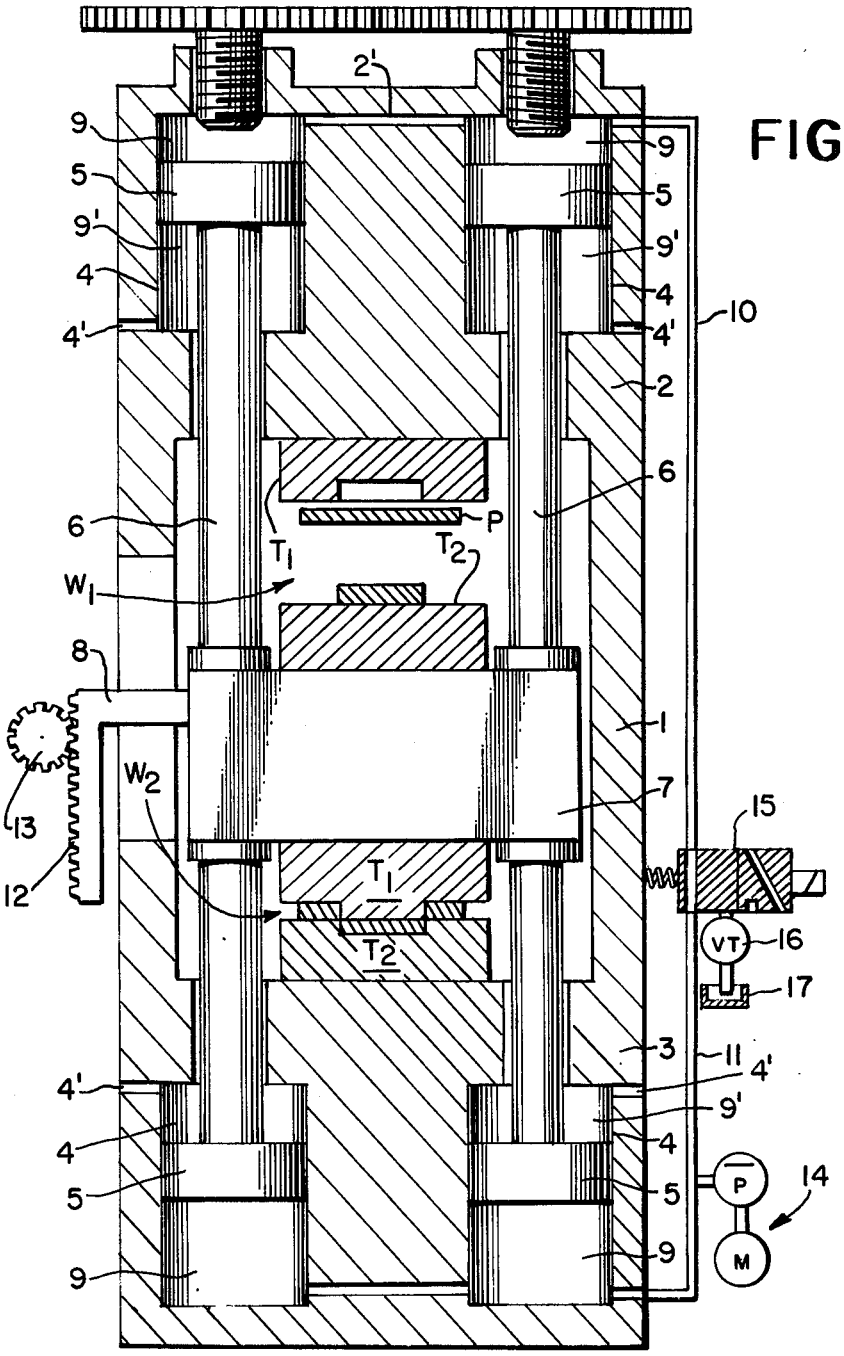
FIG. 3 is a partially schematic vertical cross-section of a third embodiment of a hydraulically driven press in accordance with the present invention.

A third embodiment, as illustrated in FIG. 3, is identical to that shown in FIG. 1 with the exception that the press ram 7 mounts a top tool $T_1$, in addition to bottom tool $T_2$ and the cross beam 3 carries a further bottom tool $T_2$ so as to form two work spaces in a manner identical to that shown in FIG. 2. Accordingly, like numerals have been used in FIG. 3 to designate parts common to the previously described embodiments, and reference can be made to such previous descriptions for their nature and operation which remain unchanged.

While the above description and the claims hereinafter refer to a top and bottom cross beam, as readily apparent, this applies solely to a vertical hydraulic press. However, the present invention is fundamentally independent of the position of the parts of the press with respect to the direction of the action of gravity, and the present invention accordingly is also applicable with the same effect to a horizontal press.

While I have shown and described two embodiments in accordance with the present invention, it is understood that the same is not limited thereto but is susceptible of numerous changes and modifications as known to one having ordinary skill in the art and I therefore do not wish to be limited to the details shown and described herein but intend to cover all such modifications as are encompassed by the scope of the appended claims.

I claim:

1. A hydraulically operated press which includes a press frame having a first and second cross beam between which a press ram is displaceable by at least two cylinder-piston means operable in two directions by a pressure medium supplied from at least one pressure medium source, characterized in that each cylinder-piston unit includes a cylinder arranged in the first cross beam and in the second cross beam, a piston is displaceably guided in each of the cylinders, each of the pistons has an effective piston surface upon which the pressure medium impinges so as to displace the respective pistons in one direction, and piston rod means connected to the press ram for joining together the pistons of the respective cylinder-piston units, wherein a working space is provided between the press ram and the first cross beam and between the press ram and the second cross beam, characterized in that the press ram executes a working stroke in two directions of movement, an auxiliary drive means is provided for driving the press ram in idle strokes preceding each working stroke in both directions of movement, each cylinder-piston unit includes a cylinder chamber means in the first and second cross beams for accommodating the pressure medium, means are provided for communicating the cylinder chamber means of one of the cylinder-piston units with the cylinder chamber means of the other cylinder-piston unit in the respective cross beams, at least one control valve means is provided for selectively controlling a flow of the pressure medium from the pressure medium source between the cylinder chamber means in the respective cross beams, a first pressure medium conduit means is arranged between the control valve means and the cylinder chamber means of the first cross beam, a second pressure medium conduit means is arranged between the control valve means and the cylinder chamber means of the second cross beam, said control valve means being constructed such that one of the pressure medium conduit means and the cylinder chamber means associated with the respective working stroke directions are selectively connected to the pressure medium while the other pressure medium conduit means associated with the other cylinder chamber means is relieved of the pressure medium.

2. A hydraulically operated press which includes a press frame having a first and second cross beam between which a press ram is displaceable by at least two cylinder-piston means operable in two directions by a pressure medium supplied from at least one pressure medium source, characterized in that each cylinder-piston unit includes a cylinder arranged in the first cross beam and in the second cross beam, a piston is displaceably guided in each of the cylinders, each of the pistons has an effective piston surface upon which the pressure medium impinges so as to displace the respective pistons in one direction, and piston rod means connected to the press ram for joining together the pistons of the respective cylinder-piston units, characterized in that an auxiliary drive means is provided for driving the press ram in an idle stroke preceding a working stroke in a direction of the working stroke, and in that each cylinder-piston unit includes a cylinder chamber means in the first and second cross beams for accommodating the pressure medium, means are provided for communicating the cylinder chamber means of one of the cylinder-piston units with the cylinder chamber means of the other cylinder-piston unit in the respective cross beams, at least one control valve means is provided for selectively controlling a flow of pressure medium from the pressure medium source between the cylinder chamber means in the respective cross beams, a first pressure medium conduit means is arranged between the control valve means and the cylinder chamber means of the first cross beam, a second pressure medium conduit means is arranged between the control valve means and the cylinder chamber means of the second cross beam, said control valve means being constructed such that the pressure medium source is connected to the second pressure medium conduit means while the first pressure medium conduit means to the cylinder chamber means in the first cross beam is relieved of pressure medium.

3. A press according to one of claims 1 or 2, characterized in that a throttle means which is effective in a discharge direction of the pressure means is operatively connected to the pressure medium conduit means which relieves the cylinder chamber means of the pressure medium.

4. A press according to one of claims 1 or 2, characterized in that a flow regulating valve which is effective in the discharge direction of the pressure medium is operatively connected to the pressure medium conduit means which relieves the cylinder chamber means of the pressure medium.

5. A press according to claim 4, characterized in that a stop means is provided for limiting a displacement of each piston or piston rod.

6. A press according to claim 5, characterized in that the stop means is arranged in one of the cross beams so as to be effective in a working stroke direction of the press ram.

7. A press according to one of claims 1 or 2, characterized in that the cylinders in each of the cross beams are mutually parallel, and in that the respective cylinders in the first cross beam are in alignment with the respective cylinders in the second cross beam.

8. A press according to claim 7, characterized in that the auxiliary drive means includes a rack mounted on the press ram and a pinion selectively drivable in two directions engageable with said rack.

9. A press according to claim 7, characterized in that the auxiliary drive means includes hydraulic means operatively connected to the press ram for selectively driving the press ram in two directions.

10. A press according to claim 9, characterized in that the hydraulic means includes a further cylinder-piston unit having a cylinder and a piston guided therein, said last-mentioned piston dividing the last-mentioned cylinder into an upper and a lower working space, and in that means are provided for selectively communicating the upper and lower working spaces with the pressure medium source.

11. A press according to claim 10, characterized in that said means for selectively communicating the upper and lower working spaces includes further pressure medium conduit means and a further control valve means arranged between the further pressure medium conduit means and the pressure source means.

* * * * *